US006354608B1

(12) United States Patent
Syrkos

(10) Patent No.: US 6,354,608 B1
(45) Date of Patent: Mar. 12, 2002

(54) INDEPENDENT WHEEL SUSPENSION SYSTEM

(76) Inventor: Yves Syrkos, 33, rue Des Sorbiers, Blainville, QBC (CA), J7C 5E4

( * ) Notice: Subject to any disclaimer, the term of this patent is extended or adjusted under 35 U.S.C. 154(b) by 0 days.

(21) Appl. No.: 09/635,841

(22) Filed: Aug. 11, 2000

(51) Int. Cl.[7] ..... A63C 17/02; B60G 7/00
(52) U.S. Cl. ..... 280/11.225; 280/124.129
(58) Field of Search ..... 280/11.221, 11.207, 280/11.225, 11.27, 11.28, 87.042, 124.129, 124.11; 16/44

(56) References Cited

U.S. PATENT DOCUMENTS

| | | | | | |
|---|---|---|---|---|---|
| 3,041,656 | A | * | 7/1962 | Goodall | 16/44 |
| 3,174,176 | A | * | 3/1965 | Olson | 16/44 |
| 4,736,965 | A | * | 4/1988 | Smith | 280/714 |
| 4,811,972 | A | * | 3/1989 | Wiley, Jr. | 280/683 |
| 5,704,621 | A | | 1/1998 | Lazarevich et al. | |
| 5,816,588 | A | | 10/1998 | Nicoletti | |
| 5,823,543 | A | | 10/1998 | Burns et al. | |
| 5,931,480 | A | | 8/1999 | Schroeder | |
| 5,951,027 | A | | 9/1999 | Oyen et al. | |
| 6,053,512 | A | | 4/2000 | Chang | |
| 6,109,623 | A | * | 8/2000 | Roman et al. | 280/11.22 |
| 6,149,167 | A | * | 11/2000 | Kao et al. | 280/11.225 |
| 6,196,557 | B1 | * | 3/2001 | Gerard | 280/11.28 |
| 6,209,889 | B1 | * | 4/2001 | Alfieri et al. | 280/11.224 |
| 6,308,964 | B1 | * | 10/2001 | Chang | 280/11.19 |

FOREIGN PATENT DOCUMENTS

| | | | | |
|---|---|---|---|---|
| EP | 0559179 A1 | * | 9/1993 | 280/11.225 |
| WO | WO 93/14840 | * | 8/1993 | 280/11.225 |

* cited by examiner

*Primary Examiner*—Brian L. Johnson
*Assistant Examiner*—Gerald B. Klebe

(57) ABSTRACT

The independent wheel suspension system of the present invention provides an optimal shock absorption in which the shock absorber is easily activated by the weight of the user to provide for an improved maneuverability of the movable structure. The system includes a truck for mounting on the movable structure, a swing arm pivotally connected to the truck for rotation around a horizontal axis between first and second limit positions, at least one wheel rotatable on said swing arm, a shock absorbent device to bias the swing arm in the first position and having a shock absorber and a guide, and a user accessible tension adjuster for adjusting the tension of the shock absorber in accordance with the desired stiffness for use or preference. The guide has a first end pivotally connected to the truck about an axis parallel to the horizontal axis. The shock absorber is mounted coaxially on the guide and has opposite ends abutting the swing arm and a second end of the guide respectively, the second end of the guide freely moves in a plane perpendicular to the horizontal axis, whereby the shock absorbent device can freely follow rotation of the swing arm between the limit positions by pivoting about the first end of the guide. This independent suspension system can be optimally applied to any device mounted on roller(s), or wheel(s), that would benefit from such an adjustable independent suspension system.

17 Claims, 3 Drawing Sheets

INDEPENDENT WHEEL SUSPENSION SYSTEM

FIELD OF THE INVENTION

The present invention relates to a wheel suspension system and more particularly to a wheel suspension system that provides independent wheel suspension and optimal shock absorption with a user accessible tension adjustment device.

BACKGROUND OF THE INVENTION

The field of wheel suspension system taken, for example, within the context of its application to in-line roller skates has experienced a great deal of interest over the past few decades. As the standard four (or five) wheel roller skate, which was used primarily for recreational means in indoor arenas, was adapted to outdoor use for both recreation and as a means of transportation, new design features needed to be adopted to the wheel suspension system. The new application of the wheel suspension system needed to be strong and stable enough to handle the weight and balance of people of varying height and weight as well as able to easily absorb the shocks caused by uneven and rough terrain and small objects or bumps always present on the road or tracks.

In the hopes of improving the quality of the ride, various new suspension systems were designed to improve the shock absorption of in-line roller skates.

U.S. Pat. No. 5,816,588 issued to Nicoletti on Oct. 6, 1998 discloses a carrier for an in-line roller skate with a removable suspension means to provide variation in the distance between the wheels to increase shock absorption and increase maneuverability.

U.S. Pat. No. 5,823,543 issued to Burns et al on Oct. 20, 1998 discloses a suspension system for an in-line boot with a double pivot mechanism attached to a boot while U.S. Pat. No. 5,951,027 issued to Oyen et al on Sep. 14, 1999 discloses a shock absorption system with a double piston wheel suspension mechanism.

U.S. Pat. No. 5,704,621 issued to Lazarevitch et al on Jan. 6, 1998 discloses a suspension system with C-shaped springs secured to side rails positioned on either side of the wheels.

The limitations of the prior art is that the tension of the shock absorption member of previously available models, if any, has to be professionally adjusted by the manufacturer/retailer. We know that the tension of roller blade wheels has to be altered depending on the degree of expertise of the user of when the latter wishes to increase his speed while gliding in a circular motion as opposed to when he wishes to skate in a straight line. In an attempt to solve this problem some systems are provided with different wheel or tension components for different tension levels. This was both inconvenient for the product user as well incurred an added expense in production. None of the known products provides the ability for the user to easily and quickly adjust the tension of the shock absorption unit of each individual wheel.

A further limitation of known suspension systems is that none of then provides an independent suspension system with a wheel mechanism that allows for as great a displacement when an upward force is applied to the wheel.

OBJECTS OF THE INVENTION

It is an object of the present invention is to provide improved independent suspension system for mounting a wheel than what is currently available on the market.

It is another object of the present invention to provide the user with an independent suspension system for mounting a wheel that allows for immediate and simple tension adjustment by the user.

It is still an object of the present invention to provide the user with an independent suspension system for mounting a wheel that has an improved angle of pivotal travel and thus provides an increased shock absorption and a smoother ride.

It is a further object of the present invention to provide the user with an independent suspension system for mounting a wheel whose system includes a specially designed truck frame with curvilinear cutouts adapted to receive rearwardly pivoted respective wheel unit.

It is further object of this invention to provide a simple inexpensive system to manufacture and upkeep.

The present invention pertains to an independent suspension system for mounting a wheel to be used for any device mounted on rollers or wheels such as, but not limited to, in-line roller skates and the like recreational equipment designed for rough terrain maneuverability.

SUMMARY OF THE INVENTION

The present invention provides a wheel suspension system for mounting on a movable structure, comprising:

a truck for mounting on said movable structure;

a swing arm pivotally connected to said truck for rotation around a horizontal axis between first and second limit positions;

at least one wheel rotatable on said swing arm;

a shock absorbent device biasing said swing arm in said first limit position and including a shock absorber and a guide, said guide having a first end pivotally connected to said truck about an axis parallel to said horizontal axis, said shock absorber mounted substantially coaxially on said guide and having opposite ends abutting said swing arm and a second end of said guide, respectively, said second end of said guide freely moving in a plane perpendicular to said horizontal axis, whereby said shock absorbent device can freely follow rotation of said swing arm between said limit positions by pivoting about said first end of said guide; and a user accessible tension adjuster for adjusting the tension of said shock absorber.

Preferably, the pivotal travel between the first and second limit positions corresponds to a swing angle varying between fifteen and forty degrees.

BRIEF DESCRIPTION OF THE DRAWINGS

In the annexed drawings, like reference characters indicate like elements throughout.

DETAILED DESCRIPTION OF THE PREFERRED EMBODIMENTS

With reference to the annexed drawings the preferred embodiments of the present invention will herein be described for indicative purposes and by no means as of limitation.

Figure 1:
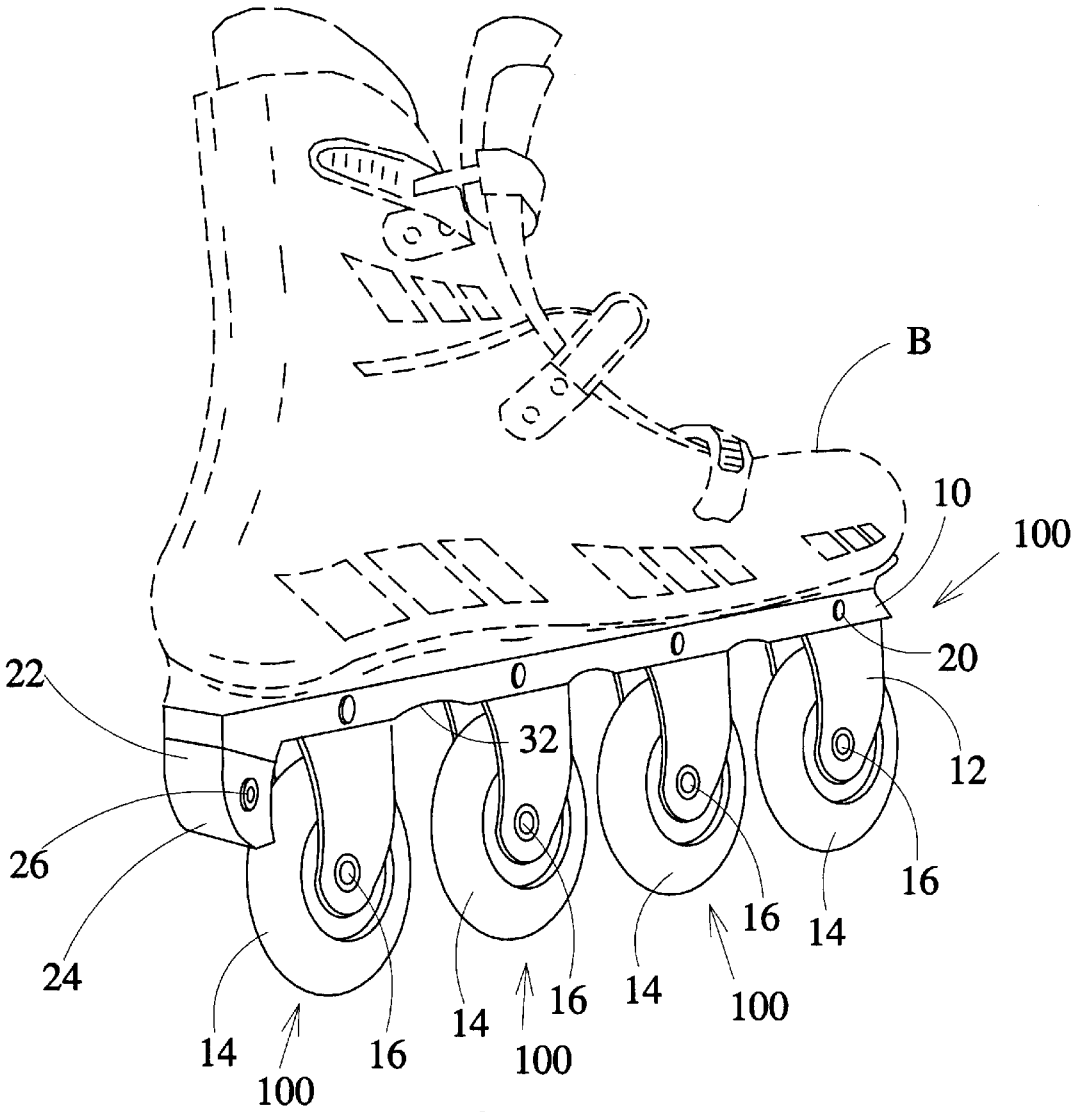
FIG. 1 is a perspective side view of a plurality of a same embodiment of an independent wheel suspension system according to the present invention.

FIG. 1 shows a perspective side view of a plurality of a same embodiment 100 of an independent suspension system according to the present invention, for preferably mounting one wheel 14 (or roller). The suspension system 100 includes supporting frame, preferably made up of an outer truck structure 10, a swing arm wheel support unit 12 pivotally secured thereto for rotation around a horizontal axis, and a shock absorbent device member 30, preferably a shock absorber coil spring 34, having an accessible tension adjustment device, preferably a screw-nut assembly 35, for adjusting the tension of coil spring 34 and guiding its displacement. The spring 34 and its guide are mounted in between the truck structure 10 and the swing arm wheel support unit 12.

Figure 2:
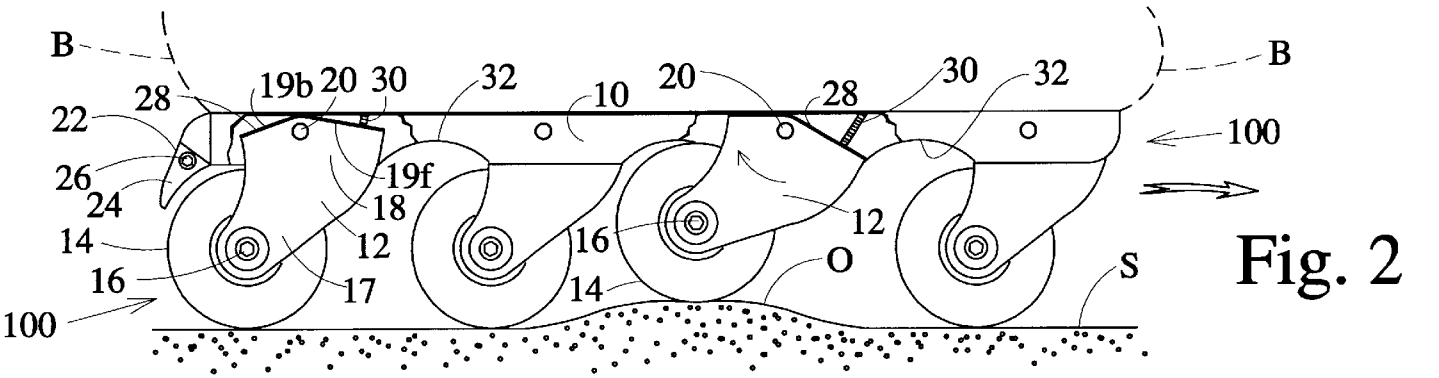
FIG. 2 is a partially sectioned side view of the embodiment of FIG. 1.

Preferably, a plurality of independent wheel suspension systems 100 are all pivotally secured to a same truck structure 10 attached to the underside, usually rigid, of a rolling device or movable structure, for example an in-line roller-skate boot B (as shown by the dashed lines in FIG. 1), the suspension systems 100 being positioned in-line from front to back. As seen in FIGS. 1 and 2, the wheels 14 and their respective suspension system 100 function independently of each other.

The swing arm wheel support unit 12 preferably includes a rear lower section 17 rotatably supporting the wheel 14 via a shaft 16 and a front upper section 18 adapted to be pivotally mounted to the truck structure 10 via a pin 20, for rotation between a first and a second limit positions. Accordingly, the truck structure 10 is preferably made out of an inverted U-shaped cross-section bar to support and protect the shock absorbent member 30.

The upper section 18 of the wheel support unit preferably includes a substantially horizontal and forwardly extending first plate 19*f* and a downwardly, with an angle preferably varying between fifteen (15) and forty (40) degrees, and rearwardly extending second plate 19*b*. First and second plates 19*f*, 19*b* being adapted to abut the truck structure 10 in the first and second swing arm wheel support unit limit positions respectively, shown in solid and dashed lines in FIG. 3 respectively.

Figure 3:
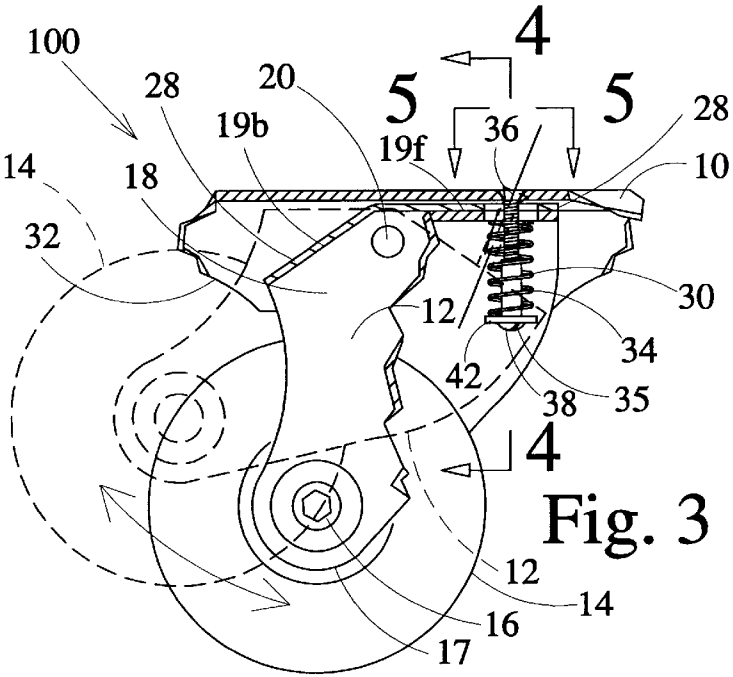
FIG. 3 is an enlarged partially sectioned side view of the embodiment of FIG. 1, showing the two pivotal limit positions of the wheel support unit.

At rest, with no weight supported by the suspension system 100, the latter is biased in its first limit position, as shown in solid lines in FIG. 3, by the shock absorbent member 30. During normal rolling of the wheels 14 supported by the respective suspension system 100, the latter is adapted to have its shock absorbent member 30 setting the wheel support unit 12 at essentially mid position between the two limit positions, as depicted in FIG. 2 for the frontmost and the two rearmost suspension systems.

When hitting an obstacle O or bump on the road surface S or uneven and rough terrain/road tracks, the wheel 14 pushes its swing arm support unit 12 up to its second limit position, depending on the size of the obstacle O, as shown for the second frontmost suspension system of FIG. 2, and by dashed lines in FIG. 3.

Obviously, more than one wheel 14 could be mounted on a same shaft 16, if required.

Also, the truck structure 10 preferably includes a curvilinear cutout 32 rearwardly positioned from the swing arm support unit 12 and adapted to receive the wheel 14 when the support unit 12 is nearby the second limit position, in order to avoid physical contact between the wheel 14 and the structure 10.

The suspension system 100 may further include a brake unit 22 releasably secured to the truck structure 10 rearwardly of the swing arm support unit 12, such as for the rearmost suspension system of FIG. 2. The brake unit 22 includes a preferably rubber type material pad 24 adapted to be abut by the wheel 14 immediately before the support unit 12 reaches its second limit position, upon application of an external force by the user. Depending on the external force, the wheel 14 is either decelerated or completely stopped from rotating. The brake pad 24 is releasably secured by a screw-nut arrangement 26 for easy interchangeability after complete wear.

In order to prevent hard shocks when the first and second plates 19*f*, 19*b* of the wheel support unit 12 abuts the truck structure 10, they are preferably covered by a layer of elastomer or rubber type material 28, thus smoothing off the impacts.

Figure 5:
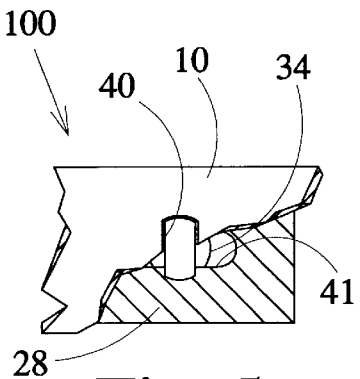
FIG. 5 is a partially sectioned view taken along line 5—5 of FIG. 3.
Figure 4:
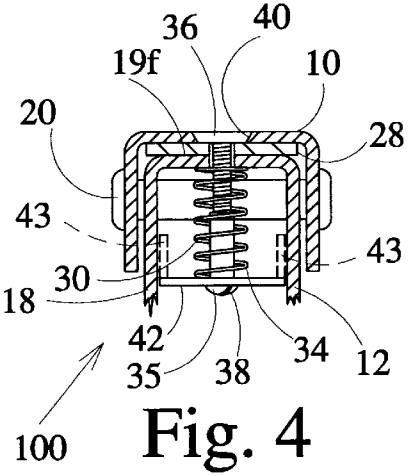
FIG. 4 is a section view taken along line 4—4 of FIG. 3.

As shown in FIG. 4, the tension of the spring 34, itself secured between the structure 10 via the screw-nut guide assembly 35 and the upper section 18 of the support unit 12, is regulated by the screw-nut assembly 35, preferably coaxial to the spring 34. The screw-nut assembly 35 consists of a guide for the spring 34 with a top end part 36 pivotally secured to the truck structure 10 in order to enable a bottom end part 38 to freely move in a plane perpendicular to the axis of pin 20 in response to the rotation of the support unit 12. This rotational displacement of the top part 36 is enabled by the truncated shape of its head positioned into a countersink type hole 40 in the truck structure 10, and the slot hole 41 provided into the first plate 19*f* of the top section 18 of the support unit 12, as illustrated in FIG. 5. The adjustment of the tension of the spring 34 is simply made by the user tightening the bottom part 38 into the top part 36 using a tool such as a standard screwdriver to compress the two ends of the spring 34 abutting the bottom part of the guide and the first plate 19*f* of the swing arm 12 respectively. Preferably, an elongated washer 42 prevents the screw-nut assembly 35 from lateral swinging. The adjustment of the tension is preferably limited by the limited tightening of the bottom part 38 to the top part 36. Alternatively, optional ears 43 upwardly projecting from the washer 42, shown in dashed lines in FIG. 4, could also be used to limit the adjustment of the tension of the spring 34.

With an external and substantially vertical force applied to the wheel 14 while hitting a rock, a bump or the like, the entire swing arm support unit 12 is forced to pivot clockwise, when referring to FIG. 3, and compress the spring 34 of the shock absorbent member 30 between the first plate 19*f* and the bottom part 38 of the screw-nut assembly 35, itself retained by the truck structure 10. When the external force is removed, the spring 34 restores the support unit 12 into its previous position.

Figures 6, 7, 8:
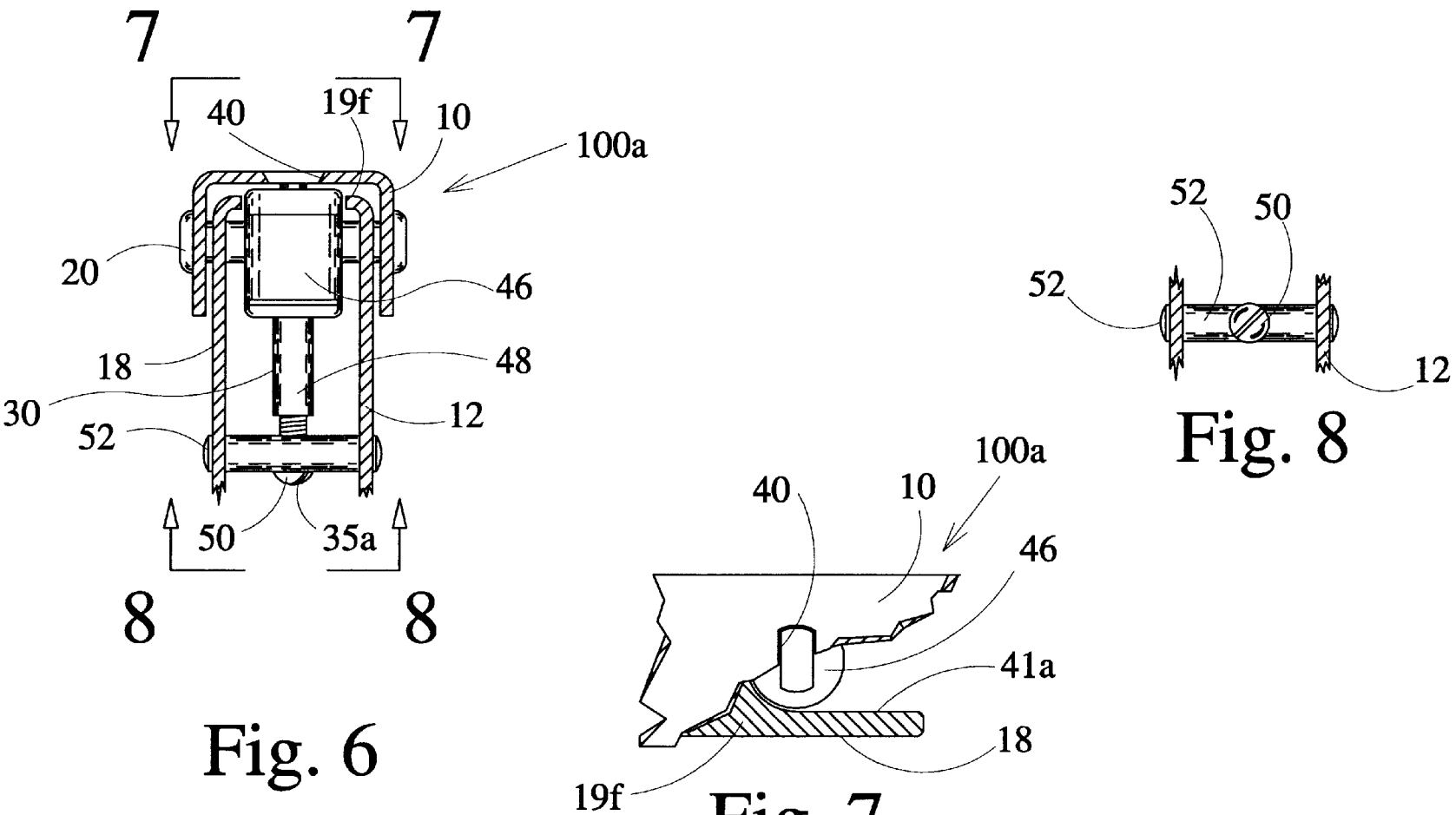
FIG. 6 is a view similar to FIG. 4 showing a second embodiment of the shock absorbent of a wheel suspension system according to the present invention.
FIG. 7 is a view similar to FIG. 5 showing the embodiment of FIG. 6.
FIG. 8 is a section view taken along line 8—8 of FIG. 6.

Alternatively, the shock absorbent member could also be either a piece of any resilient material such as rubber type materials (not shown), or a preferably gas piston mechanism 44 secured between the truck structure 10 and the swing arm support unit 12, as shown in FIG. 6. Similarly to the top part 36 of the screw-nut assembly 35 used with the spring 34, the top part of the piston mechanism 44 of this second embodiment 100*a*, preferably the cylinder 46, slightly pivots around its attachment point to the structure 10. The slot hole 41*a*, shown with an opened end on FIG. 7, of the first plate 19*f* is obviously sized to allow for the cylinder 46 to freely go through. The bottom end of the piston mechanism 44, namely the piston 48 is preferably pivotally secured to a transversal pin 54 mounted onto the swing arm support unit 12.

Preferably, the piston mechanism 44 also includes a screw-nut assembly 35*a* with a top part formed by a threaded blind hole into the piston 48 adapted to be engaged by the bottom part, a screw 50 attached to the pin 52, as shown in FIGS. 7 and 8.

For weight cost and anti-corrosion purposes, the truck structure 10 and the swing arm support unit 12 are preferably made out of aluminum. Obviously, depending on the usage and other requirements related to the adjustable independent suspension system 100 of the present invention, other types of materials or alloys could be used.

Although the present independent wheel suspension system has been described with a certain degree of particularity and details, it is to be understood that the disclosure has been made by way of example only and that the present invention is not limited to the features of the embodiments described and illustrated herein, but includes all variations and modifications within the scope and spirit of the invention hereinafter claimed.

I claim:

1. A wheel suspension system for mounting on a movable structure, comprising:

a truck for mounting on said movable structure;

a swing arm pivotally connected to said truck for rotation around a horizontal axis between first and second limit positions;

at least one wheel rotatable on said swing arm;

a shock absorbent device biasing said swing arm in said first limit position and including a shock absorber and a guide, said guide having a first end pivotally connected to said truck about an axis parallel to said horizontal axis, said shock absorber mounted substantially coaxially on said guide and having opposite ends abutting said swing arm and a second end of said guide, respectively, said second end of said guide freely moving in a plane perpendicular to said horizontal axis, whereby said shock absorbent device can freely follow rotation of said swing arm between said limit positions by pivoting with said first end of said guide; and a user accessible tension adjuster for adjusting the tension of said shock absorber.

2. A wheel suspension system in accordance with claim 1, wherein the shock absorber is a coil spring.

3. A wheel suspension system in accordance with claim 1, wherein said swing arm includes a rear, lower section rotatably supporting said wheel and a front, upper section pivotally connected to said truck.

4. A wheel suspension system in accordance with claim 3, wherein the upper section of the swing arm includes a horizontal and forwardly extending first plate, and a downwardly and rearwardly extending second plate abutting the truck in said first and second limit positions, respectively.

5. A wheel suspension system in accordance with claim 4, including a layer of elastomer on said first and second plates for smooth contact with said truck.

6. A wheel suspension system in accordance with claim 1, wherein said truck has an inverted U-shaped cross-section bar to rotatably support the wheel and protect the shock absorbent device.

7. A wheel suspension system in accordance with claim 5, wherein said truck includes a curvilinear cutout rearwardly of the swing arm for receiving said wheel when said swing arm is near the second limit position.

8. A wheel suspension system in accordance with claim 1, including a brake unit releasably secured to the truck rearwardly of the swing arm, the wheel abutting and rubbing against the brake unit immediately before the swing arm reaches the second limit position upon application of an external force by a user.

9. A combination of a plurality of wheel suspension systems as defined in claim 1, wherein the swing arms are coplanar and positioned in-line from front to back of said movable structure, thereby providing a plurality of in-line wheel suspension systems.

10. A combination in accordance with claim 9, wherein the swing arms are pivotally secured to a common elongated truck.

11. A combination in accordance with claim 9, including a brake unit releasably secured to the truck rearwardly of a rearmost swing arm, the wheel of the rearmost swing arm abutting and rubbing against the brake unit immediately before the rearmost swing arm reaches its second limit position upon application of an external force by a user.

12. A combination in accordance with claim 10, including a brake unit releasably secured to the truck rearwardly of a rearmost swing arm, the wheel of the rearmost swing arm abutting and rubbing against the brake unit immediately before the rearmost swing arm reaches its second limit position upon application of an external force by a user.

13. A wheel suspension system in accordance with claim 1, wherein the guide is a screw-nut assembly also defining the tension adjustment of the shock absorber.

14. A wheel suspension system in accordance with claim 1, wherein the shock absorbent device is located in front of said horizontal axis.

15. A wheel suspension system in accordance with claim 1, wherein the tension adjuster is a screw-nut assembly coaxial to the piston mechanism.

16. A wheel suspension system in accordance with claim 1, wherein the rotation of said swing arm between the first and second limit positions corresponds to a swing angle between fifteen and forty degrees.

17. A combination in accordance with claim 9, wherein said movable structure is a roller skate, the combination being in-line wheel suspensions for said roller skate.

* * * * *